United States Patent [19]

Bawa et al.

[11] Patent Number: 4,930,276

[45] Date of Patent: Jun. 5, 1990

[54] FIRE DOOR WINDOW CONSTRUCTION

[75] Inventors: Harinder S. Bawa, La Habra; Christopher P. Abbey, Cerritos, both of Calif.

[73] Assignee: Dynamics Corporation of America, Greenwhich, Conn.

[21] Appl. No.: 378,594

[22] Filed: Jul. 11, 1989

[51] Int. Cl.[5] ..... E06B 3/58

[52] U.S. Cl. ..... 52/211; 52/208; 52/212; 52/232; 52/764; 52/770

[58] Field of Search ..... 52/208, 211, 212, 776, 52/764, 778, 780, 205, 204, 765, 770, 775, 455, 232

[56] References Cited

U.S. PATENT DOCUMENTS

| | | | |
|---|---|---|---|
| 838,965 | 12/1906 | Douglas | 52/776 |
| 998,620 | 7/1911 | Leonard | 52/455 |
| 1,164,866 | 12/1915 | Rasmussen | 52/765 |
| 3,478,478 | 11/1969 | Luelz | 52/211 |
| 3,641,721 | 2/1972 | Martin | 52/212 |
| 4,603,524 | 8/1986 | Mann | 52/232 |
| 4,637,182 | 1/1987 | Ellsworth et al. | 52/211 |

FOREIGN PATENT DOCUMENTS

| | | | |
|---|---|---|---|
| 2624165 | 8/1977 | Fed. Rep. of Germany | 52/212 |
| 2185516 | 7/1987 | United Kingdom | 52/776 |

*Primary Examiner*—Michael Safavi

*Attorney, Agent, or Firm*—McCormick, Paulding & Huber

[57] ABSTRACT

A fire retardant window construction for a fire door comprises a trim strip having inner and outer members. The inner member is of a high density incombustible mineral material or ceramic and is nailed in position to securely and uniformly hold the pane of glass in the door opening. The outer trim member is of a fire retardant particle board and has an exposed wood veneer facing throughout. An intumescent caulking compound is applied between an inner portion of the outer trim member and the pane of glass.

6 Claims, 2 Drawing Sheets

FIRE DOOR WINDOW CONSTRUCTION

BACKGROUND OF THE INVENTION

This invention relates generally to fire doors having windows and, more particularly, to a means for securing and framing or trimming a pane of glass that serves as a light or vision panel in a fire retardant door. Such doors usually comprise a core of incombustible mineral material and certain of the doors are provided with an overlay on each surface in the form of a wood veneer Which is bonded to the door surface. The doors are installed in buildings to prevent the spread of fire from one part of the building to another and to fulfill this purpose the doors must of course be substantially incombustible. Nevertheless fire doors, as part of the interior of a living space, must have at least minimal aesthetic characteristics. Accordingly, the wood veneer is provided as on the aforesaid surfaces of the doors and in certain fire doors, the framing or trimming of the window or vision panel is also provided with a wood veneer. The glass pane is conventionally of the imbedded wire mesh type.

From the foregoing it will be apparent that the glass pane must be sealed around its edge to the incombustible core of the fire door and a thermal barrier must be provided by the frame and/or the trim of the window. Thus, the window frame or trim must satisfy both functional and aesthetic characteristics.

Metal frames have been used for fire door windows and have been painted to match or simulate wood but are not wholly satisfactory from an aesthetic standpoint. U.S. Pat. No. 4,637,182 to Ellsworth et al entitled Windowed Fire Door discloses a framing or trimming system wherein "bead strips" of an incombustible mineral material are provided with a wood veneer bonded thereto. The window pane is held in position by a plurality of small clips and associated nails which extend into the incombustible core of the fire door. While this construction is generally satisfactory, difficulties are encountered in installation with the plurality of small metal clips and it will of course be apparent that retention of the window pane by the clips is non-uniform along the edge of the pane. Further, adhesive bonding of the wood veneer to the mineral material of the incombustible bead strips may be less than satisfactory over time.

It is the general object of the present invention to provide an improved window trim construction wherein both thermal barrier and aesthetic requirements are fully met, wherein the retention of the pane of glass is both secure and uniform along the edge of the pane of glass, and wherein bonding of the wood veneer to the underlying material is secure over long service life.

SUMMARY OF THE INVENTION

In fulfillment of the foregoing object, a fire door is provided with a core of incombustible material and with a wood veneer facing which extends substantially throughout the area of each of the opposite surfaces thereof. The door has an opening therethrough with a pane of glass thereacross and with opposite flat surfaces of the pane of glass parallel to but spaced inwardly respectively from the exposed surfaces of the wood veneer facings. At least one elongated trim strip is provided on either side of the pane of glass and, when the opening and the associated pane of glass are rectangular as is conventional, four (4) complementary trim strips are provided on each side of the pane of glass. Each trim strip comprises elongated inner and outer members with the inner member being of a ceramic or other high density incombustible mineral material and having a first elongated surface which engages the core of the door throughout its corresponding marginal edge portion. A second surface of the inner trim member engages a pane of glass throughout a corresponding marginal edge portion thereof. Each outer trim member is coextensive with its corresponding inner trim member and is of a generally L-shaped cross section so as to extend laterally from the pane of glass about the inner trim member and parallel with the door surface beyond the marginal edge of the opening in the door. The outer member is of a fire retardant particle board and has an exposed wood veneer facing throughout.

A plurality of nails are provided and are applied so as to extend through the inner and outer members and into the core of the door whereby to secure opposite trim strips to the door and thus to secure the pane of glass in the door opening. More specifically, a first plurality of nails are applied through inner trim members and provide for the secure and uniform retention of the associated edge portion of the pane of glass in the door opening. A second plurality of nails are applied through outer members and at least enter the inner members and, and in presently preferred form, each of the nails extends into the core of the door whereby to aid in the secure retention of all trim members and the pane of glass.

A caulking material is also applied between an edge portion of each outer trim member and the pane of glass and comprises both a sealant and a thermal barrier and preferably takes the form of an intumescent compound. The inner trim member is preferably of alumina-silica and of a rectangular cross section with perpendicular first and second elongated surfaces respectively engaging the pane of glass and the core of the door.

In preferred form, the inner trim members are adapted for an overlapping corner configuration. That is, the inner trim members form right-angularly arranged corner configurations within a rectangular door opening with end portions being severed at right angles and arranged to extend in a crossing or overlapping configuration. The outer trim members are preferably severed at their ends along 45° so as to provide for beveled corner configurations. As will he apparent, resulting misalignment of joints at each corner results between inner and outer trim members for enhancement of the thermal barrier characteristics of the trim strips.

DESCRIPTION OF THE PREFERRED EMBODIMENT

Figure 1:
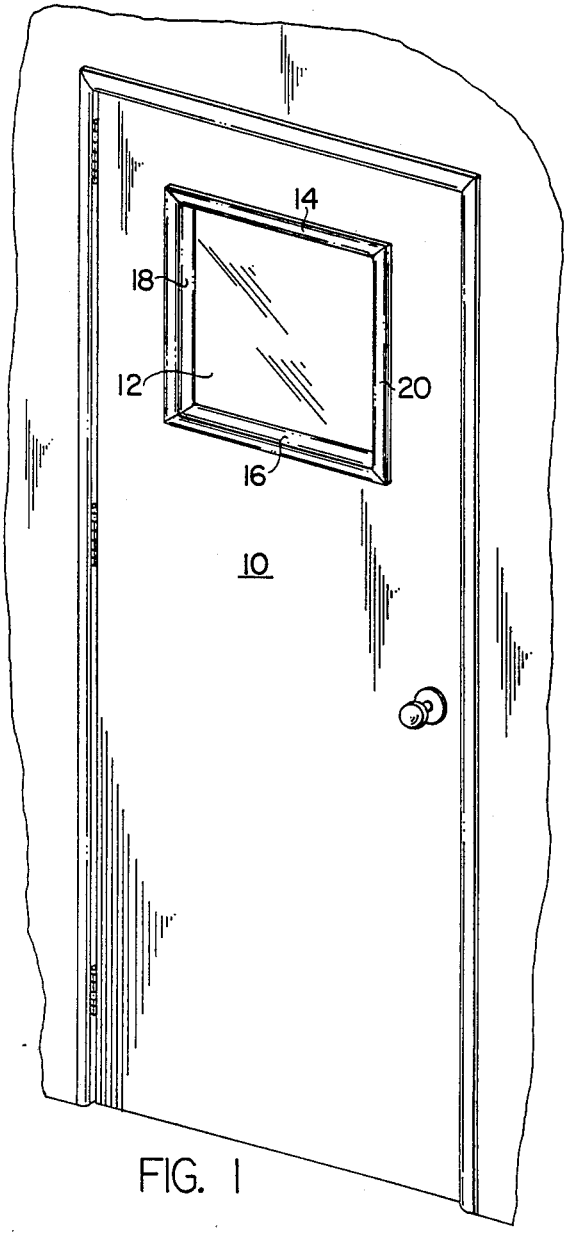
FIG. 1 of the drawings is a perspective view of the fire door and a window construction embodying the present invention.

Referring particularly to FIG. 1, a fire door indicated generally at 10 has a window or vision panel comprising a pane of glass 12, upper and lower trim strips 14, 16 and similar left and right hand trim strips 18 and 20. As best illustrated in FIG. 3, the door 10 has a core 22 with opposite surfaces thereof provided with wood veneer at 24, 24.

Figure 3:
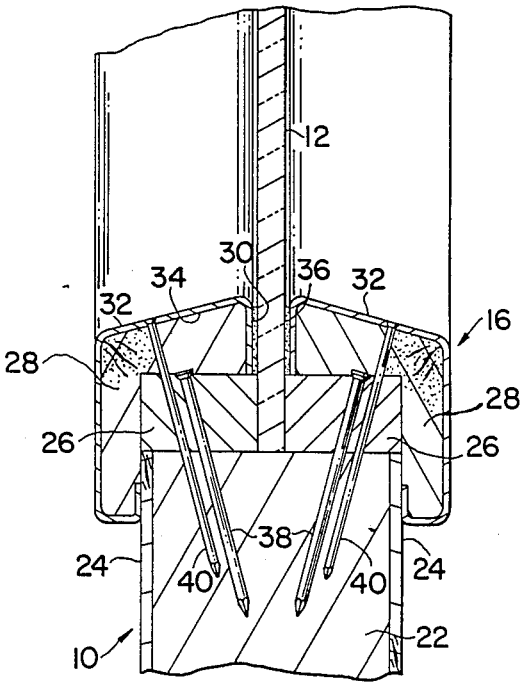
FIG. 3 is a fragmentary sectional view through a window pane, a portion of the fire door, and trim strips of the present invention.

Still referring to FIG. 3, the lower most trim strip 16 is illustrated and may be taken as representative of all four of the trim strips of FIG. 1. Each trim strip comprises an elongated inner member 26 which is generally rectangular in cross section as illustrated and an elongated outer member 28 which is generally L-shaped in cross section so as to extend laterally about the inner trim member 26. That is, an edge portion of the outer member 28 at 30 resides adjacent a marginal portion of a pane of glass 12 and an upper portion thereof extends generally horizontally outwardly to a vertically downwardly extending portion which is parallel with the wood veneer 24 and which extends beyond the lower surface of the inner trim member 26 and the door opening. A wood veneer 32 extends throughout the area of the exposed surface of the outer trim member 28 and is secured thereto by means of a conventional contact adhesive 34. The wood veneer may also extend about the edges of the outer member 28 as at 30. A caulking compound 36 is disposed between the edge 30 of each outer trim member and the pane of glass 12 and serves as both a sealant and a thermal barrier. Preferably, in accordance with the present invention, an intumescent compound is employed for this purpose.

Elongated first and second surfaces respectively engage the core of the door throughout its marginal edge and the pane of glass throughout a marginal edge portion thereof. Preferably, the inner members are of a high density incombustible mineral material and alumina-silica is preferred. The outer members 28, 28 are of a fire retardant particle board and provide a good surface for bonding of the adhesive 34 and veneer 32 resulting in a secure attachment and long service life. The extension of the outer trim member into overlapping relationship with the veneer 24 provides for an aesthetically enhanced appearance of the trim strip.

Opposite trim strips are secured in position by a plurality of nails 38, 38 whereby to secure a pane of glass in the door opening. More specifically, each inner member 26 has a plurality of nails extending therethrough into the core 22 of the door 10. The nails employed are preferably "6D×2¼ inch drywall nails" and the nails are preferably installed 3 inches on center. With this arrangement and the high density and the strength of the inner trim members 26, 26 the pane of glass 12 is held securely and uniformly along each edge portion.

A second plurality of nails 40, 40 are applied through the outer trim members 28, 28 as best illustrated in FIG. 3 and each of said nails extends into an inner trim member 26 and preferably into the core 22 of the door 10. The nails employed here are preferably "5D×2 inch finish nails" on three inch centers. In the case of both nails 38, 38 and the nails 40, 40, insertion is preferred at a slight angle inwardly from the vertical toward the center of the door as illustrated.

Figure 2:
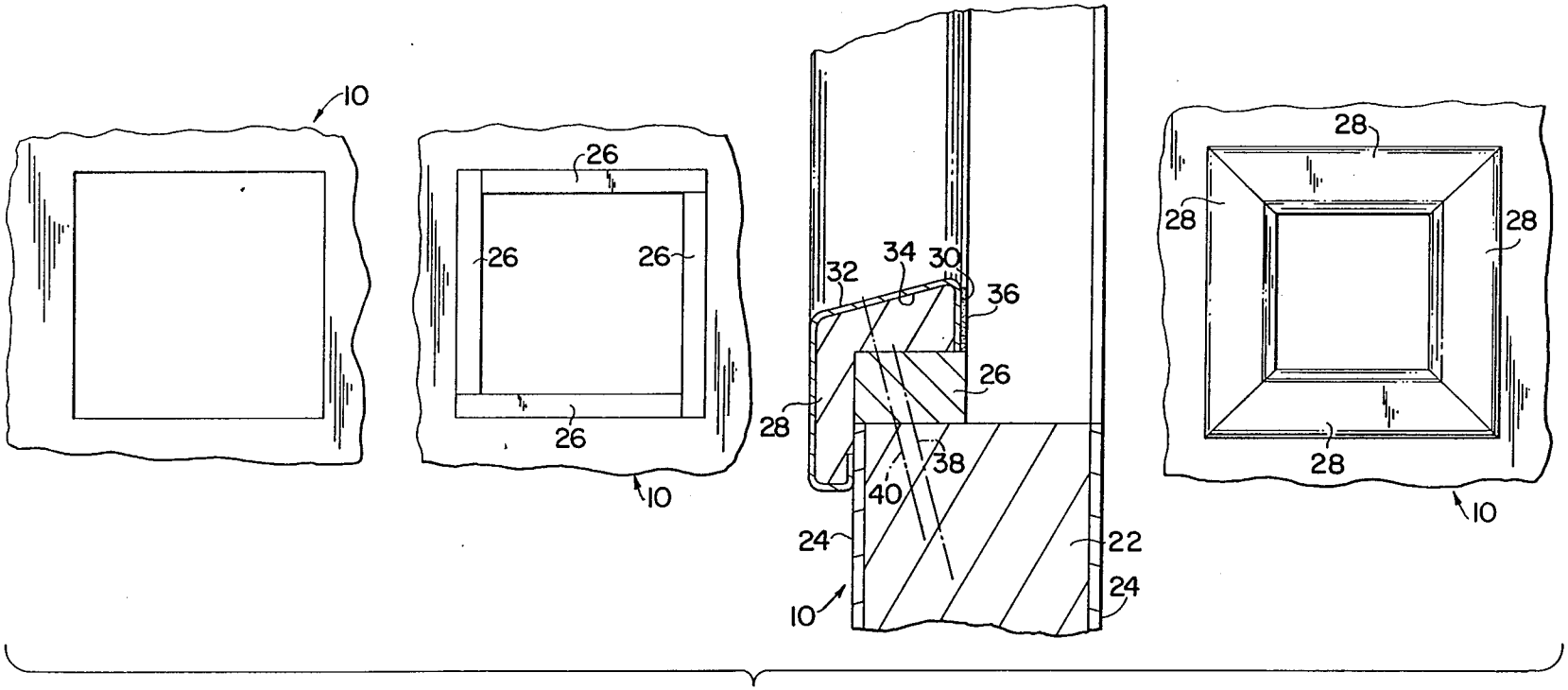
FIG. 2 is a schematic view showing various steps of installation of the trim strip of the present invention.

Referring now to FIG. 2, it will be observed that a sequential assembly procedure is illustrated schematically. In the furthermost left hand view a portion of the door is illustrated with a square or rectangular opening therethrough. In the next view to the right inner trim members 26, 26 have been installed, and in the third view to the right the outer trim members 28, 28 have been installed over the inner members, the members have been nailed in position, and caulking compound is in place for reception of a pane of glass. In the final right hand illustration the portion of the door is shown with the outer trim members in place and with installation complete.

Installation may be carried out as follows. First, the opening in the door is of course provided and the inner trim members 26, 26 are thereafter installed and nailed in position as in the second illustration. As will be observed, the end portions of the inner trim members are cut at right angles and an overlapping or crossing corner configuration is provided. The next step involves the installation of the outer trim members as in the third illustration from the left with both members nailed in position. Thereafter, a continuous bead of caulking compound is applied to the inner edge portion of the outer trim member as shown in the third illustration and the pane of glass may then be installed. Upon installation of the pane of glass, a further bead of caulking compound may be applied thereto on an opposite surface and the inner and outer trim members also installed on the opposite side thereof.

On completion of installation, the glass pane is securely retained in position with uniform pressure and retention along both sides of its marginal edge portions as exerted by the inner trim members. The outer trim members provide a clean and aesthetically pleasing appearance with both inner and outer trim members and the caulking compound contributing to the desired thermal barrier characteristics of the trim strip. Ease and convenience of installation is enhanced and a superior product results meeting all applicable fire and other standards and is well adapted to long service life.

We claim:

1. A fire door comprising a core of incombustible material with a wood veneer facing extending substantially throughout the area of each of the opposite surfaces thereof, said door having an opening therethrough with a pane of glass thereacross and with opposite flat surfaces of the pane of glass parallel to but spaced inwardly respectively from the exposed surfaces of said wood veneer facings, at least one elongated trim strip on either side of said pane of glass comprising elongated inner and outer members, the inner member being of a high density incombustible mineral material having a first elongated surface engaging the core of the door throughout the core's marginal edge around the pane of glass and a second surface engaging the pane of glass throughout a marginal edge portion thereof, and the outer member being coextensive with the inner member around the pane of glass and generally L-shaped in cross section so as to extend laterally from the pane of glass about the inner member and parallel with the surface of the door beyond the marginal edge of the opening in the door, the outer member being of a fire retardant particle board and having an exposed wood veneer facing throughout, and a plurality of nails extending through said members and into the core of the door whereby to secure the trim strip to the door and thus to secure the pane of glass in the door opening.

2. A fire door as set forth in claim 1 wherein a first plurality of nails is provided and applied through the inner member of each trim strip extending into the core of the door, and wherein a second plurality of nails is provided with said nails being applied through the outer member of each trim strip and at least through the inner member of the said trim strip.

3. A fire door as set forth in claim 1 wherein a sealant and a thermal barrier compound is disposed between an edge portion of each outer trim member and the pane of glass.

4. A fire door as set forth in claim 3 wherein said sealant and thermal barrier compound comprises an intumescent compound.

5. A fire door as set forth in claim 1 wherein said door opening is rectangular in configuration, and wherein four (4) elongated complementary trim strips are provided for each side of the pane of glass.

6. A fire door as set forth in claim 5 wherein the inner member of each trim strip is so configured and dimensioned as to provide an overlapping configuration at each corner of the pane of glass, wherein the ends of each outer member of each trim strip are provided with 45° angular surfaces for 45° joints at each corner, and wherein the inner member of each trim strip is of alumina-silica.

* * * * *